US009199712B2

(12) United States Patent
Ritz

(10) Patent No.: US 9,199,712 B2
(45) Date of Patent: Dec. 1, 2015

(54) REMOTE MOUNTED MOTOR COMMAND INPUT DEVICE FOR MARINE VESSELS

(71) Applicant: Mike Ritz, Eatonville, WA (US)

(72) Inventor: Mike Ritz, Eatonville, WA (US)

( * ) Notice: Subject to any disclaimer, the term of this patent is extended or adjusted under 35 U.S.C. 154(b) by 100 days.

(21) Appl. No.: 13/830,560

(22) Filed: Mar. 14, 2013

(65) Prior Publication Data

US 2014/0273675 A1 Sep. 18, 2014

(51) Int. Cl.

| | |
|---|---|
| ***B63H 20/12*** | (2006.01) |
| ***B63H 20/08*** | (2006.01) |
| ***B63H 25/42*** | (2006.01) |
| ***B63H 25/02*** | (2006.01) |

(52) U.S. Cl.

CPC ..... *B63H 25/42* (2013.01); *B63H 25/02* (2013.01)

(58) Field of Classification Search

CPC ..... B63H 20/12; B63H 21/213; B63H 20/08; B63H 25/02; B63H 20/007; B63H 20/00; B63H 20/02; B63H 25/14; B63H 25/16; B63H 25/18; B63H 25/20; B63H 25/22; B63H 25/24

USPC ..... 114/114 R, 144 A, 150, 162; 440/1, 53, 440/61 R, 61 S, 62, 84, 85, 86, 87

See application file for complete search history.

(56) References Cited

U.S. PATENT DOCUMENTS

| | | | | |
|---|---|---|---|---|
| 3,417,723 | A * | 12/1968 | Akermanis | 114/144 R |
| 3,796,292 | A | 3/1974 | Harrison et al. | |
| 3,874,321 | A | 4/1975 | Smith | |
| 4,263,994 | A | 4/1981 | Hayes | |
| 4,373,920 | A | 2/1983 | Hall et al. | |
| 4,531,921 | A * | 7/1985 | Teraura et al. | 440/53 |
| 4,710,141 | A | 12/1987 | Ferguson | |
| 5,046,974 | A | 9/1991 | Griffin, Jr. et al. | |
| 5,207,170 | A * | 5/1993 | Nakahama | 114/150 |
| 5,279,242 | A | 1/1994 | Johnson | |
| 5,423,277 | A | 6/1995 | Gai | |
| 5,447,456 | A | 9/1995 | Nakayasu | |
| 6,093,066 | A * | 7/2000 | Isogawa et al. | 440/63 |
| 6,352,456 | B1 | 3/2002 | Jaszewski et al. | |
| 6,413,126 | B1 | 7/2002 | Johnson | |
| 6,715,438 | B1 | 4/2004 | Hundertmark | |
| 6,776,671 | B2 | 8/2004 | Dunn | |
| 7,128,011 | B2 | 10/2006 | Altland et al. | |
| 7,325,507 | B1 | 2/2008 | Hundertmark | |
| 7,677,938 | B2 | 3/2010 | Wiatrowski et al. | |
| 7,681,513 | B1 * | 3/2010 | Hundertmark | 114/150 |

* cited by examiner

*Primary Examiner* — Anthony Wiest
(74) *Attorney, Agent, or Firm* — John Houvener

(57) ABSTRACT

This disclosure relates generally to the field of steering systems for marine propulsion, and more specifically, to a remote mounted motor command input device for marine vessels that enables a boat operator to control a motor via a tiller arm remotely mounted at a location non-adjacent to the motor. A purpose of the device is to allow for an operator to safely and conveniently control the motor, which is mounted aft of the rear platform near the bottom of the boat transom, from within the region enclosed by the main deck perimeter railing. Therefore, the operator is not tempted to control the outboard motor while standing on the rear platform of the marine vessel and is not required to leave the main deck area or enter the cockpit in order to control the motor.

7 Claims, 5 Drawing Sheets

REMOTE MOUNTED MOTOR COMMAND INPUT DEVICE FOR MARINE VESSELS

FIELD OF THE INVENTION

This disclosure relates generally to the field of steering systems for marine propulsion, and more specifically, to a remote mounted motor command input device for marine vessels that enables a boat operator to control a motor via a tiller arm remotely mounted at a location non-adjacent to the motor. For example, a boat operator may safely and conveniently control a motor which is mounted aft of a rear platform located near the bottom of a boat transom using a tiller arm which is remotely mounted to the main deck perimeter railing.

BACKGROUND

Many boats and other watercraft are equipped with two or more propulsion units for use under different circumstances. Commonly small outboard engines, e.g. below 30 horsepower, are used for trolling and are controlled by a user positioned adjacent to the outboard engine while the engine is running. The user steers the watercraft by using a tiller arm, which is attached to the engine, to pivot the engine about a generally vertical steering axis. A number of operations may be controlled by the user, such as starting and stopping the engine, throttle, tilt, trim, and shifting between forward, neutral, and reverse. In some common situations of boating, the water level is much lower, e.g. two or more feet lower, than the main deck of the watercraft which makes operation of a small outboard engine using a traditional tiller arm inconvenient and in many situations unsafe. For example, on many high-rail boats a small outboard engine affixes to a motor mount on the lower transom and, resultantly, the tiller arm is poorly positioned at or below the plane created by the main deck of the vessel. In these situations, to steer the watercraft using the tiller arm the user either leans over the rail, reaches through the rail from a crouched position, or even stands on the rear platform at the transom while the engine is running.

U.S. Pat. No. 6,352,456 to Jaszewski et al., dated Mar. 5, 2002, and fully incorporated by reference herein, discloses a marine propulsion unit apparatus wherein an outboard engine is mounted to a watercraft at the driveshaft and is allowed to pivot about a steering axis. The steering handle is adjustable within a range of travel and the entire marine apparatus can be raised or lowered to accommodate different types of marine vessels. Because outboard motor shaft lengths are standardized to fit predetermined transoms, raising or lowering the entire motor, in many situations, is an improper solution for optimizing tiller arm position. Lowering the motor from optimal propeller position will create unnecessary drag impairing performance and fuel economy. Raising the motor from the optimal propeller position may cause ventilation and/or cavitation, and may remove water intake ports from the water causing the engine to overheat. Therefore, an apparatus enabling a tiller arm to be remotely mounted non-adjacent to an outboard motor that is positioned for optimal performance is desirable.

U.S. Pat. No. 5,046,974 to Griffin, Jr. et al., dated Sep. 10, 1991, and fully incorporated by reference herein, discloses an ancillary tiller for a steerable outboard motor. The ancillary tiller provides a first shorter arm releasable interconnectable by mounting structure at its first end to an outboard motor and movably interconnecting by articulating linkage at its second end a second longer elongated arm. The ancillary tiller is particularly adapted for steerage of small fishing boats powered by outboard motors. However, the ancillary tiller is flawed in some applications, including medium-rail and high-rail watercraft, because a user must still reach over the stern railing to operate the ancillary tiller. The ancillary tiller is further flawed in the efficiency in which it can be packaged or installed onto a marine vessel because it requires a large space to accommodate the sweeping path of the second longer arm. Therefore, an apparatus enabling a tiller arm to be remotely mounted non-adjacent to an outboard motor that is positioned for optimal performance and with highly flexible and efficient packaging possibilities is desirable.

U.S. Pat. No. 5,279,242 to Johnson, dated Jan. 18, 1994, and fully incorporated by reference herein, discloses a remote control tiller arm for controlling an outboard motor comprising an inverted U-shaped steering boom. The steering boom is attached to the outboard motor on one end and extends upward and over the motor boat operator allowing the operator to steer the boat from a forward looking position. This configuration for a remote tiller is flawed in that: the sweeping path of the tiller arm is very long due to the arm being a rigid extension from the motor; the efficiency of the packaging is poor because the sweeping path must remain clear; and the apparatus requires users to become accustomed to an unfamiliar method of controlling a watercraft. Therefore, a remotely mounted tiller arm with highly flexible and efficient packaging and which allows a user to steer a motor in an already learned and natural feeling way is desirable.

U.S. Pat. No. 7,128,011 to Atland et al., dated Oct. 31, 2006, and fully incorporated by reference herein, discloses a remote control tiller system adapted to steer an outboard motor when a handheld remote control transmitter unit is selectively powered. A receiver then controls a drive unit including a motor-drive gear that applies leverage to a tiller attached to the motor. The remote control tiller discloses in the Atland patent, however, is both costly and complex. Moreover, the handheld remote control transmitter can easily be misplaced or even dropped overboard, and it is completely reliant on an electrical power source that will inevitably lose charge. Therefore, a simple remotely mounted tiller arm which is purely mechanical in construction and also stationary in location once installed is desirable.

U.S. Pat. No. 6,413,126 to Johnson, dated Jul. 2, 2002, and fully incorporated by reference herein, discloses a steering mechanism for a jet boat for side-to-side steering of a trolling motor via a steering wheel located at a pilot seat. The steering mechanism comprises a primary coupling between the steering wheel and a steering nozzle at the jet boat stern. The steering mechanism further comprises a secondary coupling between the steering nozzle and the trolling motor such that the trolling motor pivots about a steering axis corresponding to the side-to-side steering of the steering nozzle controlled by the steering wheel located at the pilot seat. However, because this steering mechanism enslaves the trolling motor to the steering nozzle the system is ill-suited for an operator to steer the trolling motor from a location other than the cockpit. Moreover, this mechanism does not enable an operator to control any functions other than steering, e.g. throttle, gear selection, starting and/or killing the motor, from a location nonadjacent to the motor. Therefore, a remotely mounted tiller arm which is mechanically independent from the any other steering system and also incorporates numerous motor functions such that the motor can be entirely operated from a remote location is desirable.

For safety reasons, it is highly desirable for an operator to be capable of controlling the outboard motor from a position non-adjacent to the outboard motor; however, traditional steering wheel assemblies are: cost prohibitive; designed to be mounted in the cockpit of the vessel; and not easily installed by the novice marine enthusiast. Moreover, each of the various attempts at improving the available methods and products of controlling an outboard motor from a location non-adjacent to the outboard motor suffer from any or all of: impairing motor performance and/or fuel efficiency, being incapable of mounting non-adjacent to the motor, inflexible or inefficient packaging options, requiring a large sweep path for an extended tiller arm to swing through, being non-stationary, being reliant on an electronic power source, or requiring to be coupled with a steering wheel. Thus, many marine vessel operators resort to controlling outboard motors while standing on the rear platform aft of the main deck, thus exposing themselves to a heightened risk of falling or being swept overboard. This safety risk is exacerbated by the possibility that the outboard motor will continue to propel the boat away from the location that an operator went overboard and, consequently, leaving that operator stranded. Moreover, the most common application for a small outboard motor other than the vessels main propulsion unit, a.k.a. "kicker motor," is to propel the vessel at an optimal speed for trolling for fish. As used herein, "kicker motor," means any auxiliary outboard motor on a motorboat or sailboat, usually used for low speed operation (such as fishing), or as a backup for the primary means of propulsion. Controlling the motor from the cockpit is undesirable because that would require the operator to leave the fishing equipment unattended each time a small steering correction is needed. Also, the typical cockpit already has a steering wheel centered in the dash leaving no additional space for a steering wheel dedicated to a kicker motor. Finally, many operators are accustomed to controlling a kicker motor through a tiller arm mounted to a motor directly behind them while looking forward and, therefore, enabling an operator to control the motor from a remote location in an identical manner is desirable.

Accordingly, this application discloses a remote mounted motor command input device for marine vessels that enables a boat operator to control a motor through the use of a tiller arm remotely mounted at a location non-adjacent to the motor. The remote mounted motor command input device disclosed is: economical, capable of being mounted non-adjacent to the motor and also outside the cockpit of the vessel, easily installed by the novice marine enthusiast, highly flexible and efficient in possible packaging solutions, and is purely mechanical such that no electronic power source is required. Other benefits of the remote mounted motor command input device will become apparent throughout this disclosure.

U.S. Pat. No. 4,531,921 to Teraura et al., dated Jul. 30, 1985, is hereby fully incorporated by reference herein.

SUMMARY

This disclosure relates generally to the field of steering systems for marine propulsion, and more specifically, to a remote mounted motor command input device for marine vessels that enables a boat operator to control a motor via a tiller arm remotely mounted at a location non-adjacent to the motor. A purpose of the device is to allow for an operator to safely and conveniently control the motor, which is mounted aft of the rear platform near the bottom of the boat transom, from within the region enclosed by the main deck perimeter railing. Therefore, the operator is not tempted to control the outboard motor while standing on the rear platform of the marine vessel and is not required to leave the main deck area or enter the cockpit in order to control the motor.

BRIEF DESCRIPTION OF THE DRAWINGS

Embodiments of the present disclosure are described in detail below with reference to the following drawings.

DETAILED DESCRIPTION

A remote mounted motor command input device for marine vessels that enables a boat operator to control a motor via a tiller arm remotely mounted at a location non-adjacent to the motor is disclosed herein. Specific details of certain embodiments of the apparatus are set forth in the following description and in FIGS. 1-7 to provide a thorough understanding of such embodiments. The present remote mounted motor command input device may have additional embodiments, may be practiced without one or more of the details described for any particular described embodiment, or may have any detail described for one particular embodiment practiced with any other detail described for another embodiment. The following embodiments and descriptions are for illustrative purposes only and are not intended to limit the scope of the remote mounted motor command input device.

Figure 1:
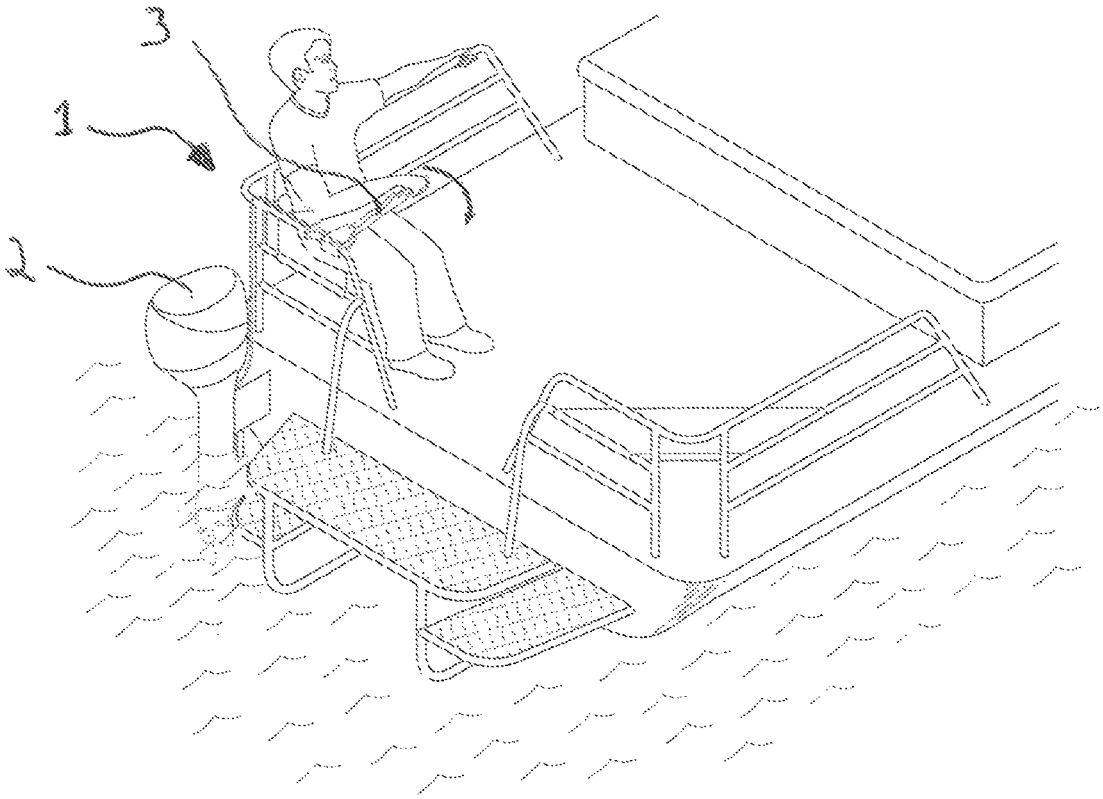
FIG. 1 is an illustration, in accordance with an embodiment of the remote mounted motor command input device for marine vessels; it illustrates a watercraft being propelled forward by an outboard motor that is being controlled by an operator from a location non-adjacent to the motor via a tiller arm.

FIG. 1 is an illustration, in accordance with an embodiment of the remote mounted motor command input device for marine vessels 1; it illustrates a watercraft being propelled forward by an outboard motor 2 being controlled by an operator from a location non-adjacent to the outboard motor through use of a tiller arm 3. The operator in this illustration is safely and conveniently controlling the outboard motor 2, which is mounted aft of the rear platform near the bottom of the boat transom, from within the region enclosed by the main deck perimeter railing. Therefore, the operator is not tempted to control the outboard motor while standing on the rear platform and is not required to leave the main deck area or enter the cockpit in order to control the motor.

Figure 2:
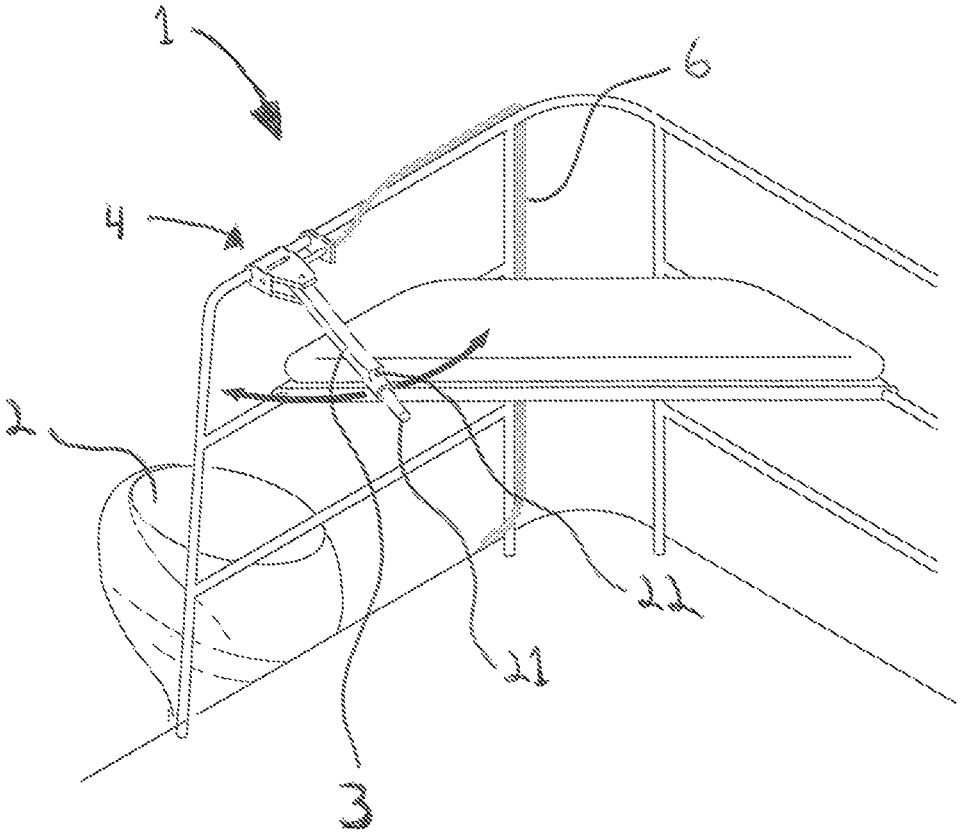
FIGS. 2-3 are illustrations, in accordance with various embodiments of the remote mounted motor command input device for marine vessels, illustrating a tiller arm remotely mounted to the railing of a watercraft and various controls routed from the remote mounted motor command input device to the motor.
Figure 3:
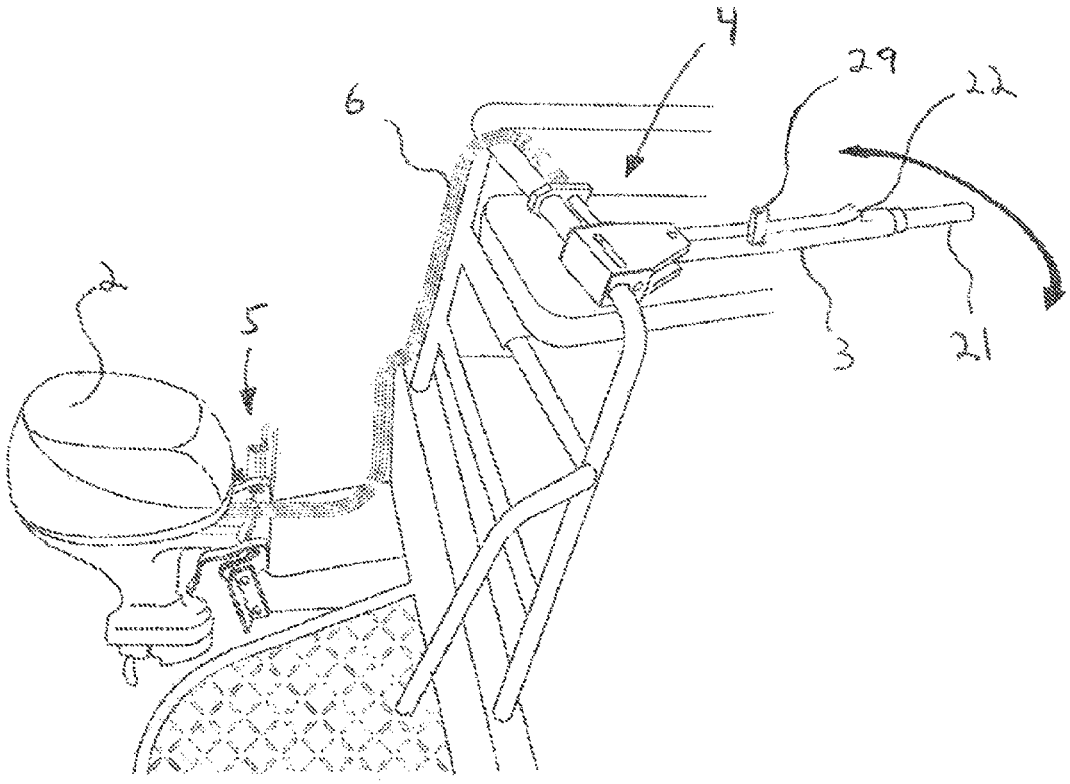

FIGS. 2-3 are illustrations, in accordance with various embodiments of the remote mounted motor command input device for marine vessels 1, illustrating a tiller arm remotely mounted to the railing of a watercraft and various controls routed from the remote mounted motor command input device 1 to the motor 2.

In certain embodiments, an input unit 4 of the remote mounted motor command input device 1 is mounted to the topmost rail of the main deck perimeter railing at the stern of a marine vessel, e.g. next to a stern seat on the main deck. The motor commands received from an operator at the input unit 4 are transmitted to an output means 5 (location shown in FIG. 3) for causing specific functions to be performed by the motor corresponding to input commands received. The output means includes a means for coupling 6 the input unit 4 and the motor 2. Although it is mounted to the main deck perimeter railing in this specific embodiment, the input unit 4 may be mounted at any other location of the marine vessel.

In some embodiments, the remote mounted motor command input device 1 is configured for receiving steering commands for rotating the motor 2 about a generally vertical steering axis. In a preferred embodiment, the means for coupling 6 comprises a marine grade push-pull control cable assembly for transmitting steering commands received at the input unit 4 to the output means 5 and, ultimately, to the motor 2. Use of a marine grade push-pull cable assembly is preferable because such assemblies are optimally suited for transmitting a rotation about one axis, e.g. a pivot axis of the remotely mounted tiller arm 3, into another axis, e.g. the steering axis of a motor. Additionally, use of a marine grade push-pull cable assembly is preferable because such assemblies: have a proven record of reliably controlling the steering of various marine vessels, are easily installable by even the novice marine enthusiast, are available in a variety of standard lengths optimal for various vessels, are corrosion resistant, and are economically desirable. Various output means 5 for causing a motor to rotate about an axis corresponding to forces applied via a push-pull cable are well known in the art and can be readily selected from. In other embodiments, the means for coupling 6 comprises a hydraulic system that uses fluid to generate power and/or transmit power. Use of a hydraulic system to transmit power is ideal in certain configurations in which the minimum bend radius required by push-pull cable assemblies cannot be met. This is because the effective routing configurations for hydraulic systems are less restrictive than those for a push-pull cable system. In these embodiments, hydraulic hoses and/or tubes are routed from the input unit 4 to the output means 5. In these embodiments, the output means 5 preferably comprises a double acting hydraulic cylinder mechanically linked to the outboard motor 2 such that fluid power transmitted through the hydraulic hoses and/or tubes causes the motor to rotate about a steering axis. Various output means 5 for causing a motor to rotate about an axis corresponding to forces applied via fluid power are well known in the art and can be readily selected from. The fluid power is generated at the input unit 4, preferably through the use of a second double acting hydraulic cylinder, by converting the leverage and movement applied to the tiller handle 3 into usable fluid power. The bore diameter and stroke of the double acting hydraulic cylinders may be sized appropriately to achieve the desired sensitivity to steering inputs.

Generally, embodiments which utilize either a push-pull cable assembly or a hydraulic system as a means for coupling 6 the input unit 4 to the output means 5 are preferable because these embodiments are likely reliable, economical, and can utilize a wide array of output means 5 currently commercially available. The foregoing embodiments and descriptions are associated with transmitting steering motor commands only. Other types of means for transmitting steering motor commands known in the art may be used. Also, the motor commands received at the input unit 4 and coupled to the output means 5 are not limited to steering motor commands. For example, motor commands received from an operator at the input unit 4 and relayed to an output means 5 via the means for coupling 6 preferably comprise: throttle for controlling the speed of the motor, a shift lever 29 for controlling the gear selection of the motor, means for starting and killing the motor, trim for controlling the angle of the motor in relation to the hull, choke for controlling the richness of the fuel mixture, or any combination thereof. Preferably, any and all types of motor commands that specific motor being controlled by the remote mounted motor command input device 1 is capable of receiving is integrated into the remote mounted motor command input device 1. In a preferred embodiment, the input unit 4 is configured for receiving a tiller arm 3 that has been removed from the motor 2 after being installed by the motor manufacturer. The majority of tiller arms installed by a motor manufacturer are integrated with numerous motor commands. For example, the tiller arm 3 preferably comprises an integral rotatable handle 21 for controlling the throttle of the motor 2 as well as an electronic start/stop button 22 for starting and killing the motor And a shift lever 29 for shifting the motor 2 into or out of forward, neutral or reverse gears. Other types of motor commands known in the art may also be used.

In some embodiments, the input unit 4 has a mechanism that prevents the motor from deviating from its last commanded position, e.g. the input unit 4 locks the position of the tiller arm 3. The mechanism (not shown) may include a set of teeth on one or more components of the input unit 4 such as the input lever 10 and the base structure 7. In these embodiments, the vessel operator will be capable of engaging and disengaging teeth on one or more components such that when the teeth are engaged the tiller arm, and ultimately the motor, is prevented from rotating about the generally vertical steering axis. In other embodiments, the input unit 4 may comprise an element that applies friction to the input lever 10, e.g. a screw element may be integrated into the base structure 7 and configured to clamp down on the input lever 10.

In some embodiments, the input unit 4 is configured to allow the tiller arm 3 to be folded up or down out of the operators way when the steering the boat via the tiller arm 3 is not required. For example, the tiller arm 3 may comprise a mechanism that allows for the arm to be folded and the input unit 4 may simply be configured to be free and clear of the tiller arms swing path. Alternatively, the input unit 4 may comprise an integrated folding mechanism to allow for the tiller arm 3 to be folding out of the operators way.

Figure 4:
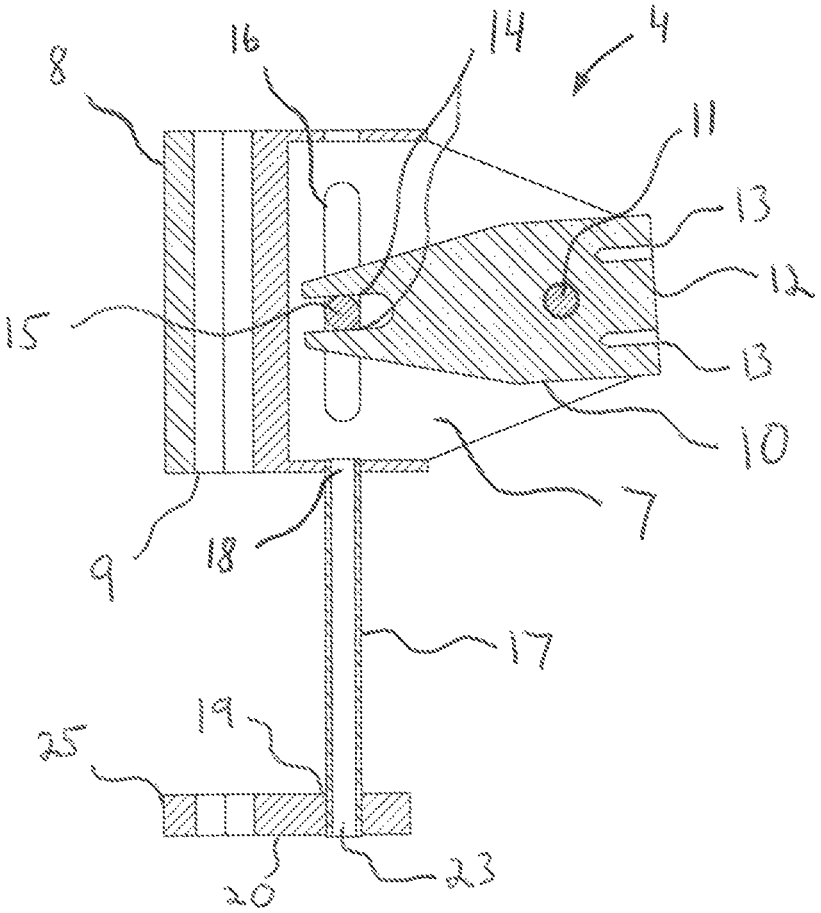
FIG. 4 is a plan view cross-section, in accordance with an embodiment of the remote mounted motor command input device for marine vessels, illustrating a mechanism for receiving steering command input.
Figure 5:
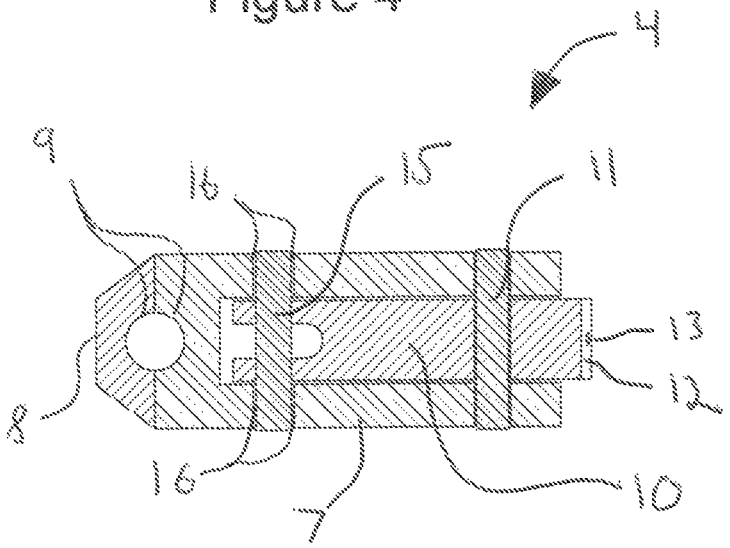
FIG. 5 is a side view cross-section, in accordance with an embodiment of the remote mounted motor command input device for marine vessels, illustrating a mechanism for receiving steering command input.

FIG. 4 is a plan view cross-section of the remote mounted motor command input device, and more specifically the input unit 4, illustrating a mechanism for receiving steering command input. FIG. 5 is a side view cross-section of the input unit 4 illustrating a mechanism for receiving steering command input. FIGS. 4-5 illustrate a preferred embodiment wherein the means for coupling 6 the input unit 4 and the motor 2 comprises a push-pull cable assembly.

In the illustrated embodiment, the input unit 4 comprises a base structure 7 that is configured for mechanically affixing, directly or indirectly, to the hull of a marine vessel. In a preferred embodiment, the base structure 7 is configured to affix to the hull indirectly via a main deck perimeter railing by enclosing the railing between the base structure 7 and a clamp 8 within a channel 9. Because many marine vessel railings are round, the diameter of the channel 9 is preferably slightly smaller than the diameter of the railing to allow for a sufficient clamping force to rigidly secure the input unit 4 to the hull. In some embodiments, the channel 9 is substantially rectangular in profile to allow for various inserts to be used for mounting the input unit 4 to various rail profiles. Such inserts have an outer profile matching the inner profile of the channel 9, and an inner profile configured to mate with the outer profile of a specific railing. Preferably, the clamp 8 is mechanically fastened to the base structure 7 with standard fasteners, e.g. black phosphate coated machine screws. The following embodiments and descriptions are for illustrative purposes only and are not intended to limit the scope of the remote mounted motor command input device. The base structure 7 can be configured for affixing to the hull of a marine vessel by any other means known in the art, e.g. it may be configured for directly or indirectly being welded or bolted to the hull.

In the illustrated embodiment, the input unit 4 further comprises an input lever 10 configured to rotate about an axis defined by a pivot 11. Here, the input lever 10 comprises a planar mounting surface 12 having two blind threaded holes 13 for the purpose of accepting a tiller arm (not shown). Most outboard motors commonly used as kicker motors, e.g. relatively small motors up to roughly 25 horsepower, come standard from the manufacturer with a tiller arm attached; such tiller arms are commonly referred to as Original Equipment Manufacturer (OEM) tiller arms, also referred to as stock tiller arm. An intended purpose of the remote mounted motor command input device 1 is to enable a marine enthusiast to remove the OEM tiller arm from a motor and attach it to the input unit 4, and more specifically, to the input lever 10. Many OEM tiller arms attach to motors via a planar surface and two blind threaded holes and, therefore, a preferred embodiment mimics this configuration. Any other means for attaching a tiller arm known in the art may be used. The input device 1 does not require the removal of a stock tiller arm. In some embodiments, a marine vessel may be configured so that a motor can be controlled by alternative means, e.g. either the input device 1 or the OEM tiller arm as installed by the manufacturer. In some embodiments, the OEM tiller arm will remain on the motor and the motor will be coupled to the input device 1 such that the motor may be controlled via two or more tiller arm located at two or more different locations on the marine vessel. A benefit of using a OEM tiller handle is that numerous controls are commonly integrated into the handle. For example, among other controls the majority of tiller arms comprise a rotatable handle as a means for controlling the throttle of the motor. It is intended for each and every control which is integrated into the stock tiller arm of a particular motor to be completely functional from the remote location of the input device 1. In some embodiments, the pivot 11 comprises a bushing (not shown) press fit into the input lever 10 to provide a bearing surface and a bolt (not shown) with an unthreaded portion, e.g. a clutch bolt, which mates with the inner surface of the bushing. In the drawings provided only a simple pivot is depicted and, as such, neither a bushing nor a clutch bolt is shown. Various pivot means suitable for this application are well known in the art, and any means known in the art may be used.

In the illustrated embodiment, the input lever 10 comprises an open ended slot 14 wherein a pin 15 rests. The pin 15 is constrained by the surfaces of the open ended slot 14 and a guide slot 16 that is integral to the base structure 7. The guide slot 16 constrains the pin 15 such that the pin remains aligned with a guide tube 17 configured to house one end of a push-pull cable assembly. The guide tube 17 is attached to the base structure 7 at a first end 18 and is attached to a guide tube support structure 20 at a second end 19. The guide tube support structure 20 is configured for enclosing the main deck perimeter railing within a second channel 24 via a second clamp 25 in the same manner as the base structure 7. At the second end 19 the guide tube 17 has a threaded inner diameter 23 configured for receiving a threaded end of a push-pull cable assembly (not shown). The guide tube 17 is intended to align and provide the required support to the end of the push-pull cable assembly where a rigid and slidable portion of the push-pull cable assembly (not shown) protrudes outward from the first end 18 and attaches to the pin 15 such that as the input lever 10 is rotated about the axis defined by the pivot 11 a control cable within the push-pull cable assembly (not shown) steering commands received at the input unit 4 are transmitted via the means for coupling 6 to the output means 5 and, ultimately, to the motor 2. The pin 15 preferably comprises a threaded through hole (not shown) configured for attaching to the rigid and slidable portion of the push-pull cable assembly (not shown) because this potion is generally threaded at its end.

Figure 6:
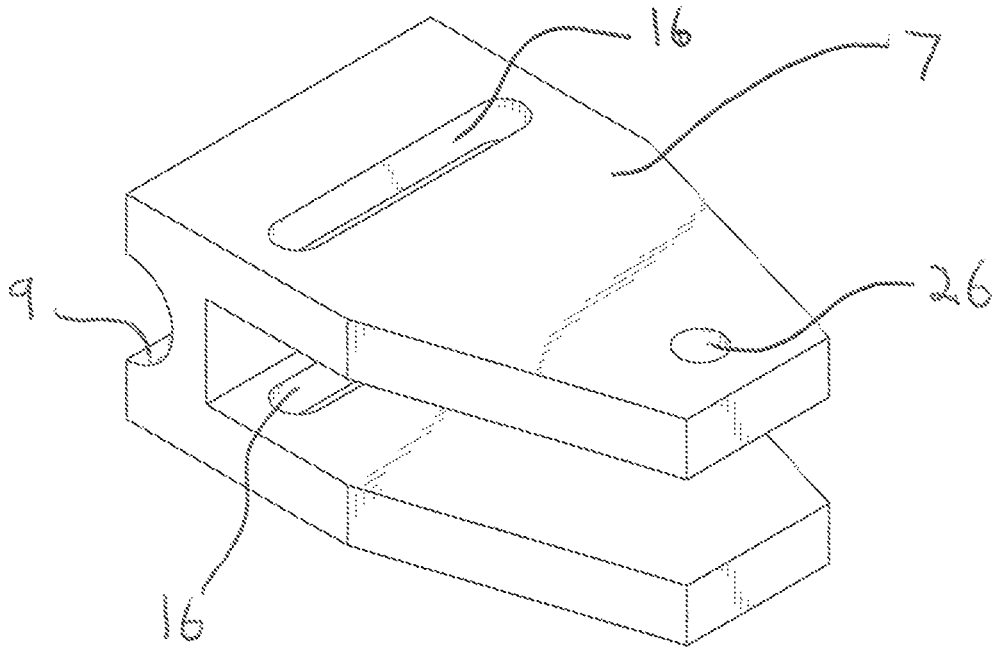
FIG. 6 is an isometric view, in accordance with an embodiment of the remote mounted motor command input device for marine vessels, illustrating a base structure component of an input unit.

FIG. 6 is an isometric view, in accordance with an embodiment of the remote mounted motor command input device for marine vessels 1, illustrating the base structure 7 of the input unit 4. Visible in FIG. 6 is the portion of the channel 9 that is on the base structure 7 and the guide slot 16. In the illustrated embodiment, the base structure has a hole 26 wherein the pivot 11 inserts.

Figure 7:
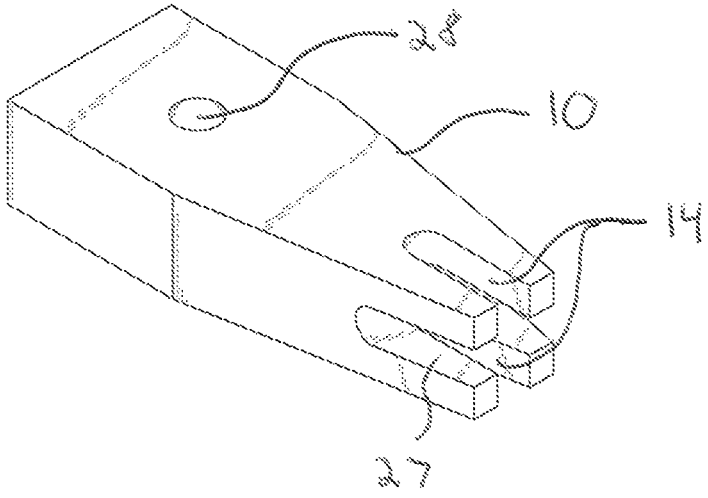
FIG. 7 is an isometric view, in accordance with an embodiment of the remote mounted motor command input device for marine vessels, illustrating an input lever component of an input unit.

FIG. 7 is an isometric view, in accordance with an embodiment of the remote mounted motor command input device for marine vessels, illustrating the input lever 10 of the input unit 4. Visible in FIG. 7 is the open ended slot 14 wherein the pin 15 (not shown in this FIG) rests. The open ended slot 14 is depicted as a double forked end such that the pin 15 is able to rest vertically within the slot and the rigid and slidable portion of the push-pull cable assembly (not shown) is able to pass through an opening 27 and attach to the pin 15. In the illustrated embodiment, the input lever 10 has a hole 28 wherein the pivot 11 inserts.

While preferred and alternate embodiments have been illustrated and described, as noted above, many changes can be made without departing from the spirit and scope of the remote mounted motor command input device. Accordingly, the scope of the remote mounted motor command input device is not limited by the disclosure of these preferred and alternate embodiments. Instead, the scope of the remote mounted motor command input device should be determined entirely by reference to the claims that follow.

What is claimed is:

1. A motor command input device for a watercraft, comprising:

an input unit, the input unit having a base structure configured to be affixed to a watercraft at a location nonadjacent to a motor, the input unit also having an input lever, the input lever having a first end and a second opposite end, the input lever pivotably attached to the base structure by a pivot pin located between the first and second opposite ends, the first end configured for receiving steering input commands from an operator through a tiller arm, the second end being configured for transmitting steering input commands to a guide pin acting within a guide slot on the base structure, a guide tube support structure aligned with the base structure of the input unit and configured to be affixed to a watercraft at a location nonadjacent to a motor, a guide tube, the guide tube attached on a first end to the base structure of the input unit and attached on a second end to the guide tube support structure, the guide tube aligned with the guide slot of the input lever; and a push-pull cable assembly attached on a first end, through the guide tube, to the guide pin and operatively connected on the second end to the motor, the push-pull cable assembly configured to transmit input commands from the movement of the tiller arm such that the motor pivots about a generally vertical steering axis corresponding to steering input commands received from the operator.

2. The motor command input device of claim 1, wherein the input unit further comprises, throttle means for controlling the speed of the motor corresponding to input commands received from an operator.

3. The motor command input device of claim 1, wherein the input unit further comprises, shifting means for shifting the motor into or out of forward, neutral or reverse gears corresponding to input commands received from an operator.

4. The motor command input device of claim 1, wherein the input unit further comprises a button for starting the motor, killing the motor, or any combination thereof, corresponding to input commands received from an operator.

5. The motor command input device of claim 1, wherein the input unit further comprises setting the choke of the motor corresponding to input commands received from an operator.

6. The motor command input device of claim 1, wherein the input unit further comprises setting the trim of the motor corresponding to input commands received from an operator.

7. The motor command input device of claim 1, wherein the first end of the input lever is configured with a mounting surface for receiving and/or mating with an ancillary tiller arm.

* * * * *